US008328416B2

(12) United States Patent
Behling et al.

(10) Patent No.: US 8,328,416 B2
(45) Date of Patent: Dec. 11, 2012

(54) SHOCK PROOF WATCH

(75) Inventors: Christoph Behling, London (GB); Delphine Cordié, La Chaux-de-Fonds (CH)

(73) Assignee: LVMH Swiss Manufactures SA, La Chaux-de-Fonds (CH)

( * ) Notice: Subject to any disclaimer, the term of this patent is extended or adjusted under 35 U.S.C. 154(b) by 232 days.

(21) Appl. No.: 12/840,917

(22) Filed: Jul. 21, 2010

(65) Prior Publication Data

US 2011/0019508 A1 Jan. 27, 2011

Related U.S. Application Data

(60) Provisional application No. 61/227,468, filed on Jul. 22, 2009.

(30) Foreign Application Priority Data

Jul. 22, 2009 (CH) ..... 01154/09

(51) Int. Cl.
*G04B 37/00* (2006.01)

(52) U.S. Cl. ..... 368/287

(58) Field of Classification Search ..... 368/141, 368/286, 287, 299, 300, 326; 968/309, 452, 968/307, 447, 878
See application file for complete search history.

(56) References Cited

U.S. PATENT DOCUMENTS

| | | | | |
|---|---|---|---|---|
| 3,727,367 | A | 4/1973 | Fujimori et al. | |
| 3,838,568 | A | 10/1974 | Zurcher et al. | |
| 4,204,396 | A | 5/1980 | Breguet | |
| 7,287,900 | B2 * | 10/2007 | Rufenacht et al. | 368/127 |
| 7,431,495 | B2 * | 10/2008 | Cretin et al. | 368/287 |
| 7,859,948 | B2 * | 12/2010 | Plomb | 368/16 |
| 2003/0112713 | A1 * | 6/2003 | Kaelin | 368/281 |

FOREIGN PATENT DOCUMENTS

| | | |
|---|---|---|
| DE | 1808170 | 6/1970 |
| FR | 1509590 | 1/1968 |

* cited by examiner

*Primary Examiner* — Edwin A. Leon
(74) *Attorney, Agent, or Firm* — Pearne & Gordon LLP

(57) ABSTRACT

An arrangement for protecting a watch movement from shocks and vibrations includes shock absorbers for mounting the watch movement within the case. The shock absorber includes a plurality of independent portions for absorbing the energy from shocks and vibrations in different portions of the frequency spectrum. The rigidity of the shocks absorbers can be adjusted from outside the watch. The watch case is made up of a network of interconnected tubes and watertightening plates without mechanical functions connected to the tubes.

15 Claims, 1 Drawing Sheet

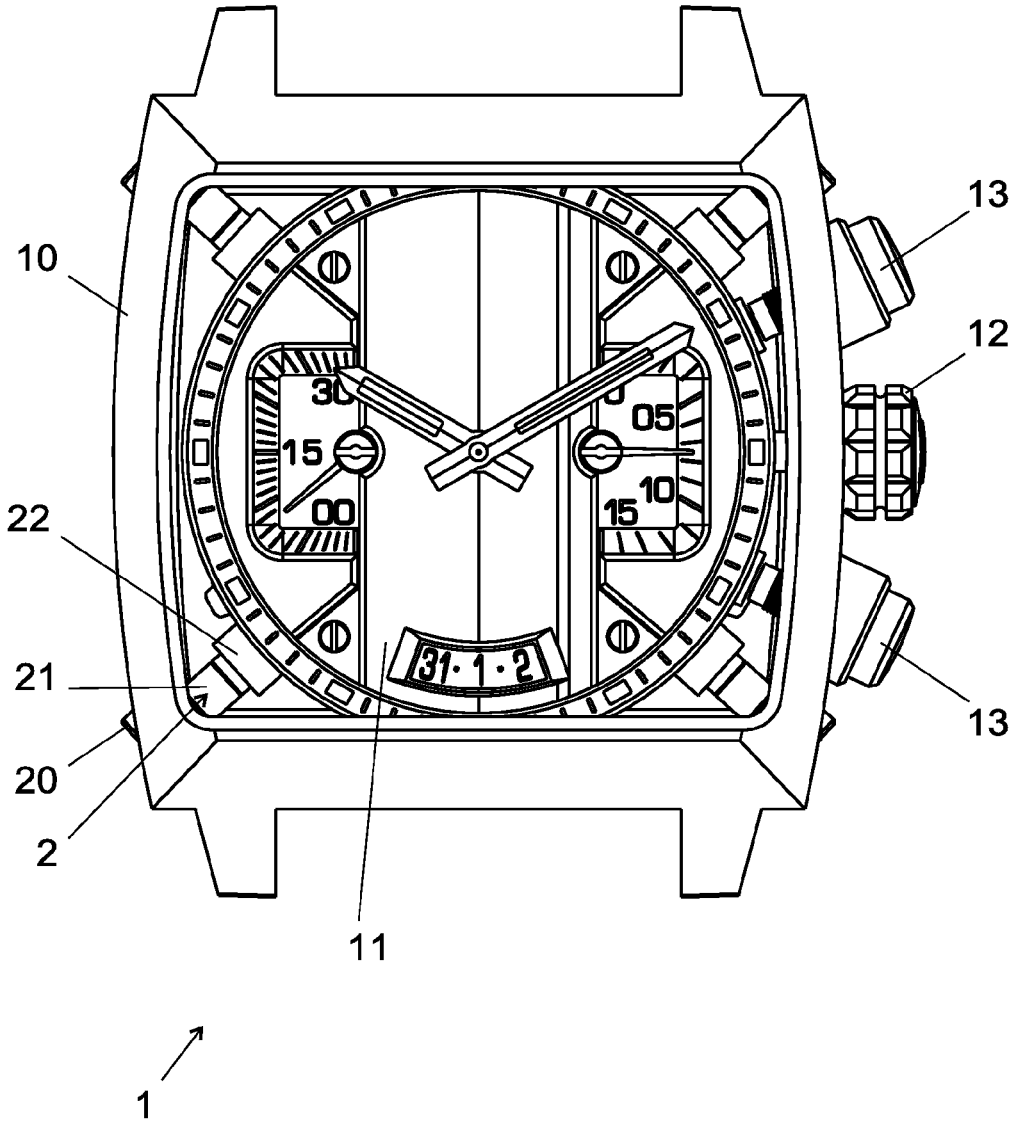
10
13
12
22
21
20
2
11
13
1
30
15
00
05
10
15
31·1·2

SHOCK PROOF WATCH

RELATED APPLICATIONS

The present applications claims priority of U.S. provisional application US61/227,468 filed on Jul. 22, 2009, the contents whereof being incorporated by reference. The present applications also claims the priority of Swiss Patent Application CH2009/01154 filed on Jul. 22, 2009, the contents whereof being incorporated by reference.

TECHNICAL FIELD

The present invention relates to watches, in particular wristwatches. The present invention is also directed to a watch movement mounting for shock and vibration absorption.

RELATED DOCUMENTS

Numerous arrangements have been proposed to maintain a watch movement in its case while assuring a protection against shocks and vibrations. For example, the use of an elastic material such as rubber between the case and the middle bezel is well known.

U.S. Pat. No. 4,204,396 discloses a watch with a plurality of shock absorbers for the watch movement. Each shock absorber has a first portion moulded in the watch casing, a second portion moulded in a baseplate of the watch movement, and an elastically deformable connecting portion extending between the first portion and the second portion. This solution is only adapted to special watches having a moulded casing and a movement with a moulded baseplate, but not to more usual watches with a metal casing and baseplate. Moreover, the maximal length of the shock absorbers is limited by the space between the watch movement and the inner side of the casing. Since both elements have a circular shape, this distance is constant and necessarily small. The limited length of the shock absorber results in poor shock damping ability.

U.S. Pat. No. 3,838,568 discloses an electronic watch movement mounting and connection. Resilient spring fingers are used for mounting the watch movement within the case. Again, the space between the case and the movement, and the type of shock absorber, is not sufficient for effective shock absorption. This solution may be adequate for protecting electronic watches, but not for more vulnerable mechanical movements where a better shock absorption is required.

U.S. Pat. No. 3,727,367 discloses a shock proof watchcase in which a shock-absorbing member is supported between the case and the back cover, in order to absorb shocks both in the axial and transverse directions of the watch. The shock absorbing member needs a sufficient rigidity for supporting the watch movement in the transverse position, and for absorbing shocks in the axial direction. This is a serious constraint and limits the freedom of the designer to choose the most suitable shock damping element.

FR1509590 discloses another arrangement for suspending a movement within a watch case, using a crenellated ring.

DE1808170 discloses a watch using an encasing ring made up of a shock absorbing material, such as Viton (registered trademark).

If those arrangements assure a certain protection against vibrations and small shocks, they are not sufficient for preventing damages to the watch movement, in particular to the regulating organ, in case of more violent shocks. A metal wristwatch that falls on a hard surface, such as concrete, from a height of 1.2 meter, for example, may subject to a negative acceleration in the order of 5000 G, or more, generating a high amplitude shock wave through the casing and to the movement. This shock wave has components in different parts of the frequency spectrum, including low frequency and ultrasonic frequency waves. It is not possible to absorb all those spectral components with the above described damping means. The rigid does not absorb any significant part of the energy, which is directly transmitted to the movement through the connection between case and movement.

The shocks produce various deformations of those connections and of the movement, including torsions, shear and compression.

One aim of the invention is thus to provide a more effective arrangement for supporting the movement within the case while giving it an efficient protection against shocks and vibrations.

Another aim is to provide an assembly of case, movement and mounting means which, as a whole, is more effective for damping shocks.

BRIEF SUMMARY OF THE INVENTION

In one aspect, those aims are achieved with new shock absorbers for mounting a watch movement within a case, wherein the shock absorber comprises a plurality of independent portions for absorbing the energy of shocks and vibrations in different portions of the frequency spectrum.

In this specification and in the claims, "independent portions" means portions which are produced or machined separately, such as two different parts or components. Those portions may be fixed to each other by any possible means during assembly, and may work in collaboration.

According to another aspect of the invention, those aims are also achieved with new shock absorbers for mounting a watch movement within a case, wherein the shock absorber comprises a plurality of different materials for absorbing the energy of shocks and vibrations in different portions of the frequency spectrum. In one possible embodiment, one part of the absorber is made up of metal, and includes for example a steel based helicoidal spring, while another part of the absorber is made up of a softer material, such as a synthetic, rubber, colloidal or gel material for example.

The use of different portions and/or different materials for the shock absorbers thus allows absorption of the energy caused by an impact over a wider spectrum. For example, energy may be damped not only in the low, acoustic frequencies, but also at higher ultrasonic frequencies over 16 KHz.

The different portions and/or materials of the shock absorber are preferably serially connected, for the shock wave to successively pass all portions/materials before reaching the movement.

At least one of the portions, or preferably the whole shock absorber, preferably acts as a wave guide that guides sound waves at or near a given acoustic frequency, and damps waves at other frequencies. At least a substantial portion of the acoustic wave transmitted through each wave guide will be reflected to the wave guide when it reaches the watch movement, due to the different impedance of the wave guide and of the movement.

According to another, possibly independent aspect of the invention, the above mentioned aims are also reached with a watch having a non circular case, for example a substantially square, rectangular or barrel-formed shape, and a substantially circular watch movement. The shock absorbers are then advantageously mounted between each inside corner of the case and the outer side of watch movement. This arrangement is beneficial, since the shock absorbers are mounted where the distance between the case and the movement is the longest, and thus may have a greater length, and provide a better shock absorption. Furthermore, the reduced number of shock absorbers helps in reducing manufacturing costs while resulting in a nearly isostatic mounting of the watch movement within the case.

In yet another, possibly independent aspect of the invention, at least one externally accessible screwable element is available for modifying properties, such as rigidity, of at least one shock absorber. In one embodiment, this or those screws are used for mounting the shock absorbers within the case, and pass through holes of the case. Turning the screws in one or the other direction induces a change in the longitudinal compression applied to the shock absorber, and thus a variation of their shock absorbing properties.

In yet another, possibly independent aspect of the invention, the watch case comprises a frame made up of tubes assembled with tubes assembling means and connecting plates connected to the tubes for tight, water-proof closing of the watch case. The tube frame is arranged for absorbing most part of the energy from impacts, and for transmitting only a damped part of this energy to means connecting this case to the watch movement. Thus, at least a part, or preferably most part, of the energy from any impact or vibration is absorbed within a specially conceived frame as part of the watch case. In a preferred embodiment, this case and the damping elements connecting the case to the movement are mutually adapted for attenuation of energy from common impacts, and for avoiding unwanted resonance between the case and the damping elements, especially resonance as frequencies caused by common shocks.

The crown rod between the watch crown and the watch movement preferably comprises another damping elements from protecting the watch movements from shocks transmitted through the crown rod. Advantageously, the crown rod is made up of several parts interconnected through a link, such as for example a gear, that allows both parts to slide longitudinally with respect to each other.

Moreover, the watch movement may be protected with other damping elements from axial shocks from the watch glass.

BRIEF DESCRIPTION OF THE FIGURE

The present invention will be better understood by referring to the accompanying FIGURE which represent, by way of examples, several particular embodiments of the invention.

FIG. 1 is a view from above of a watch according to one embodiment of the invention.

DESCRIPTION OF THE PREFERRED EMBODIMENTS

FIG. 1 shows an example of wristwatch 1 comprising a case 10 and a movement, for example a mechanical movement, behind a watch dial 11. Reference number 12 designates the watch crown while reference numbers 13 are push buttons.

In the illustrated example, the watch case 10 has an approximately square, or cushion formed shape, while the watch movement has an approximately circular outer shape. The watch movement may also be encaged in a circular supporting ring. The distance between the inner side of the case 10 and the outer side of the watch movement (or ring) is thus variable, leaving a greater space at each of the four corners of the watch.

In a preferred embodiment, there is no direct contact between the watch movement or ring and the case 10. The movement is entirely suspended within the case by damping elements (shock absorbers) 2 provided at, or near, each corner, in order to mount the movement within the case and to absorb shocks and vibrations between the case and the movement. The shock absorbers 2 can preferably be observed through the watch glass, in order to check if they are damaged or need tensioning for example.

In this specific example, each damping element comprises two independent portions:

An outer portion 21, made up of a first material, such as steel or any other suitable metal, for absorbing mechanical waves in a first range of frequency. This portion may be cylindrical, or include a helicoidal spring, or any other element with a shape adapted for damping shocks at low or acoustic frequencies. In one embodiment, this first portion thus acts as a high pass filter and attenuates low frequencies of the shocks and vibrations.

An inner portion 22, possibly comprising of another material, such as a synthetic material, a gel colloidal material, or rubber for example. This portion may be cylindrical, helicoidal etc and connected to the longitudinal end of the outer portion. In one example, the inner portion 22 includes a piston, a cylinder, and an elastic compressible material between the piston and the cylinder. In one embodiment, this second portion thus acts as a silent block, i.e., as a low or band pass filter, and attenuates high, supersonic frequencies above 15 KHz.

The inner and outer portions are serially connected, in the sense that shock waves coming from the case 10 have to go through both portions of this damping element before reaching the movement. The outer portion absorbs most of the energy in one frequency band, while the inner portion absorbs most of the energy that remains in another frequency bands; the maximal damping efficiency of each portion is reached at a different frequency. Damping elements having more than two different portions may also be used.

The use of exactly four damping elements is advantageous for the following reasons. First, using more than four elements would make the system more expensive, highly hyperstatic, and allow more vibrations to reach the movement through those elements. Three damping elements are sufficient to suspend the movement in an ideal isostatic way, but do not allow a symmetric arrangement within a square or cushion-shaped case—the movement would then be more sensitive to shocks from certain directions. Three damping elements may however be used within a circular shaped case.

The longitudinal axis of each damping element is preferably oriented toward the geometry or gravity center of the watch movement; each damping element is thus aligned with the opposite damping element. In this way, the residual shock energy transmitted to the movement by each damping element is directed to the center of the movement, and at least partially compensated by energy transmitted by the other elements, resulting in compression rather than flexions of the movement.

In one embodiment, the damping elements 2 have a preferred mode of deformation along their longitudinal compression axis, while other deformation modes, including transverse deformations, torsions, etc require a higher energy to occur.

In the illustrated embodiment, the shock absorbers 2 are mounted onto the case 10 using screws 20, or similar parts, that go through the case and can be accessed from the outside of the case. This makes the assembly of the watch movement inside the case easier; the movement is provisory placed inside the case 10, and the damping elements 2, or parts of the damping elements, are inserted from the outside of the case to maintain the movement permanently. In this embodiment, the shock absorbers are preferably mounted close to each corner, but not exactly at the edge, in order to avoid a screw which is placed on the outside edge of the case.

The crown rod is then mounted from the outside, in a conventional manner.

In one embodiment, the rigidity of the damping elements 2 can be adjusted, preferably using the above described mounting screws 20 or equivalents. Rotating the screw modifies the compression of an elastic material within the damping elements 2, and modifies their damping characteristic, including the maximal damping factor and/or the frequency at which the attenuation is maximal. It is thus possible to adapt from outside of the watch the suspension of the movement to the intended use, for example when doing sport or at night. Different adjustments may be chosen, depending on whether one primarily wants to compensate vibrations which may affect the watch accuracy, or to protect it against shocks. A limited number of predetermined adjusting positions may be provided, and possibly marked on each screw's head and on the casing. The adjustment may also be adapted to the type of movement in the watch, to the type of bracelet and/or to the user's wrist diameter.

In one arrangement, there is no direct contact between the outer side of the movement or ring and the inner side of the case 10. In case of large shocks, and important deformations of the damping elements 2, one or several parts of the movement may however abut against the case, thus preventing the damping elements themselves from being damaged. Those portions of the case and/or of the movement that may abut against each other may then be covered with an elastically compressible material to prevent damage to inner components of the movement.

The crown rod that connects the crown 12 to the movement preferably comprises several articulated parts, for example over a linking element such as a gear that can longitudinally slide with respect to each other. Longitudinal shocks are thus not transmitted through the rod; this protects the rod from breaking and avoids transmission of shocks through the crown and the crown rod. In case of higher shocks that the linking element can't sufficiently absorb, the rod is advantageously conceived in order to break before any inner component of the movement. In a similar way, the connection between the push buttons and the movements is preferably made of several parts, including spring elements.

According to one another, possibly independent aspect, the watch case 10 is itself made up of several interconnected parts linked so as to be deformable and to absorb at least one part of the shocks from impacts. The whole watch, including the watch case, the movement and the damping elements between the movement and he case, is conceived and modellized so as to resist to large shocks and vibrations without damage for sensible parts, such as the regulating organ. Moreover, this arrangement is optimized so as to avoid resonant frequencies in the useful frequency band, for example below 50 KHZ. In one embodiment, the watch case 10 and the damping elements 2 are designed together in order to ensure absorption of energy over a large frequency spectrum, from 0 Hz to 50 KHz for example, while avoiding resonance at those frequencies.

In one embodiment, the watch case 10 comprises a three-dimensional network of bar-shaped linear elements (hollow tubes or solid cylinders) which are mutually connected and forms a spatial framework. The bar-shaped elements thus intersect at defined points of intersection, and define a three-dimensional lattice structure. External forces caused by impacts and vibrations to the lattice induce elastic deformations of this lattice, optimized for an optimal absorption of energy in the desired frequency band while avoiding permanent damages to the bar-shaped elements, or to connecting elements between those elements.

This framework which is built with this lattice forms the central, bearing structure of the watch case and is able to absorb the stresses to which the watch is exposed. Covering plates and elements are mounted on this network to ensure water-tightness and improve the appearance; those elements do not play a significant role in the mechanic of the watch. The damping elements 2 that connect the watch case 10 to the watch movement are preferably directly mounted onto this tube network. The casing and the damping elements between casing and movement are preferably conceived and optimized as a whole, in order to provide for maximum damping efficiency in the complete range of frequencies.

REFERENCE NUMBERS ON THE FIGURES

1 Wristwatch
10 Watch case
11 Dial
12 Crown
13 Push buttons
2 Shock absorbers (damping elements)
20 Screwable portion of the shock absorbers
21 First, outer part of shock absorber
22 Second, inner part of shock absorber

The invention claimed is:

1. An arrangement for protecting a watch movement from shocks and vibrations, said arrangement comprising a plurality of shock absorbers for mounting a watch movement within a case, wherein the shock absorber comprises a plurality of independent and different portions serially connected, the independent and different portions absorbing the energy from shocks and vibrations in different portions of the frequency spectrum.

2. The arrangement of claim 1, wherein different portions of the shock absorber comprise a plurality of different materials for absorbing the energy of shocks and vibrations in corresponding different portions of the frequency spectrum.

3. The arrangement of claim 2, one shock absorber portion being made up of metal, one another portion of the same shock absorber being made up of a softer material, such as a synthetic, rubber, colloidal or gel material.

4. The arrangement of claim 1, wherein one said portion is constructively adapted for absorption of energy in a low part of the frequency spectrum, while another portion of the same shock absorber is constructively adapted for absorption of energy in a higher part of the spectrum.

5. The arrangement of claim 1, wherein said case has a non circular shape, wherein said movement has a substantially circular outer shape, and wherein said shock absorbers are mounted between each inside corner of said case and the watch movement.

6. The arrangement of claim 1, comprising no more than four shock absorbers between said case and said movement.

7. The arrangement of claim 1, wherein said shock absorbers are mounted where the distance between the case and the movement is the highest.

8. The arrangement of claim 1, comprising at least one adjusting element for adjusting a property, including rigidity, of at least one shock absorber, from the outside of said watch case.

9. The arrangement of claim 8, said adjusting element comprising one screw element for mounting said shock absorber from the outside of said case and for adjusting the compression of said shock absorber.

10. The arrangement of claim 1, said watch case including a frame made up of tubes and tube connecting elements, connecting plates being connected to said tube frame for water-proof closing of said frame.

11. The arrangement of claim 10, wherein said shock absorbers are connected directly to said frame.

12. The arrangement of claim 1, comprising a crown and a further damping element for connecting said crown to said watch movement.

13. The arrangement of claim 1, said shock absorbers being visible from the outside of the watch.

14. A watch comprising:

a movement;

a case;

a plurality of shock absorbers for mounting said movement within said case, at least one of the shock absorber comprising a plurality of independent and different portions serially connected, the independent and different portions absorbing the energy from shocks and vibrations in different portions of the frequency spectrum.

15. The watch of claim 14, wherein said case has a non circular shape, wherein said movement has a substantially circular outer shape, and wherein said shock absorbers are mounted between each inside corner of said case and said movement.

* * * * *